US010047695B2

(12) United States Patent
Pegg et al.

(10) Patent No.: US 10,047,695 B2
(45) Date of Patent: Aug. 14, 2018

(54) CRANKCASE OIL CATCHER WITH MOVABLE GUIDE

(71) Applicant: Ford Global Technologies, LLC, Dearborn, MI (US)

(72) Inventors: Ian Graham Pegg, Chelmsford (GB); Roland Paul Stark, Hitchin (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/604,499

(22) Filed: May 24, 2017

(65) Prior Publication Data

US 2017/0350346 A1 Dec. 7, 2017

(30) Foreign Application Priority Data

Jun. 7, 2016 (GB) ..... 1609910.3

(51) Int. Cl.
*F02F 7/00* (2006.01)
*F01M 11/00* (2006.01)

(52) U.S. Cl.
CPC ..... *F02F 7/0021* (2013.01); *F01M 11/0004* (2013.01); *F01M 2011/0016* (2013.01); *F01M 2011/0033* (2013.01); *F01M 2011/0091* (2013.01)

(58) Field of Classification Search
CPC ..... F02F 7/0021; F01M 11/0004; F01M 2011/0016; F01M 2011/0033; F01M 2011/0037; F01M 2011/0045
See application file for complete search history.

(56) References Cited

U.S. PATENT DOCUMENTS

| | | | |
|---|---|---|---|
| 4,270,497 | A | 6/1981 | Valerio |
| 4,519,348 | A | 5/1985 | Hamilton |
| 9,670,803 | B2 | 6/2017 | Pegg et al. |
| 2009/0277416 | A1 | 11/2009 | Saito |
| 2013/0312696 | A1 | 11/2013 | Mordukhovich |

(Continued)

FOREIGN PATENT DOCUMENTS

| | | | |
|---|---|---|---|
| GB | 2278400 | A | 11/1994 |
| GB | 2279109 | A | 12/1994 |

(Continued)

OTHER PUBLICATIONS

Intellectual Property Office of Great Britain, Combined Search and Examination Report Issued in Application No. GB1609910.3, dated Nov. 17, 2016, South Wales, 8 pages.

*Primary Examiner* — Jacob Amick
(74) *Attorney, Agent, or Firm* — Julia Voutyras; McCoy Russell LLP

(57) ABSTRACT

A crankcase assembly for an engine comprising: a crankcase comprising a crank sump; the crank sump comprising primary and secondary sump volumes; one or more crankcase oil catchers, the crankcase oil catchers comprising surfaces to catch dispersed oil in the crankcase and direct the oil away from a crankcase casing wall and towards the crank sump, wherein the crankcase oil catchers are provided above a crankshaft and below a piston of the engine; and one or more guides to collect oil and guide the oil to the primary sump volume. At least a portion of the guide is movable between a first configuration in which the guide collects the captured oil that would otherwise have.

20 Claims, 7 Drawing Sheets

(56) References Cited

U.S. PATENT DOCUMENTS

| | | | | |
|---|---|---|---|---|
| 2015/0252697 | A1* | 9/2015 | Pegg ..... | F01M 11/0004<br>123/41.42 |
| 2015/0300220 | A1* | 10/2015 | Mordukhovich .. | F01M 11/0004<br>184/106 |
| 2017/0016365 | A1 | 1/2017 | Pegg et al. | |

FOREIGN PATENT DOCUMENTS

| | | | |
|---|---|---|---|
| GB | 2524013 | A | 9/2015 |
| GB | 2534248 | A | 7/2016 |
| JP | 2002276320 | A | 9/2002 |
| JP | 2010190044 | A | 9/2010 |

* cited by examiner

CRANKCASE OIL CATCHER WITH MOVABLE GUIDE

RELATED APPLICATIONS

This application claims priority to Great Britain Patent Application No. 1609910.3, filed Jun. 7, 2016. The entire contents of the above-referenced application are hereby incorporated by reference in its entirety for all purposes.

FIELD

The present disclosure relates to a crankcase assembly, in particular, but not exclusively, a crankcase assembly comprising an oil catcher configured to catch dispersed oil in a crankcase and direct the oil towards a crank sump and away from a crankcase casing wall.

BACKGROUND

During warm up of an internal combustion engine, the engine block structure acts as a large heat sink because the thermal inertia of the engine block structure is an order of magnitude greater than the coolant and oil. As a result, the engine block structure takes longer to warm up than the oil.

By way of example, hot oil returning from a piston cooling gallery, which has been heated by the combustion events, may hit a crank of the engine and the oil may be thrown against the cooler crankcase. When the oil is thrown against the crankcase wall, the oil loses heat due to the large thermal inertia of the crankcase and the large surface area of the crankcase. Similarly, oil returning from the cylinder head has been heated and loses heat as it returns through the engine block to the oil sump. The resulting colder oil has a higher viscosity, which leads to higher friction losses. This in turn leads to worse fuel consumption and cabin heating.

The present disclosure seeks to address these issues.

STATEMENTS OF INVENTION

According to an aspect of the present disclosure there is provided a crankcase assembly for an engine comprising: a crankcase comprising a crank sump; the crank sump comprising a primary sump volume and a secondary sump volume; one or more crankcase oil catchers, the crankcase oil catchers comprising one or more surfaces configured to catch dispersed oil in the crankcase and direct the oil along the surfaces of the crankcase oil catcher away from a crankcase casing wall and towards the crank sump, wherein the crankcase oil catchers are provided above a crankshaft and below an associated piston of the engine; and a guide configured to collect oil captured by one or more of the crankcase oil catchers and guide the oil to the primary sump volume, wherein the guide is provided beneath a bottom edge of the one or more crankcase oil catchers such that oil falling from the bottom edge of the crankcase oil catchers drops onto the guide at least when in the first configuration, and wherein at least a portion of the guide is movable between: a first configuration in which the guide collects oil captured by the one or more crankcase oil catchers that would otherwise have flowed into the secondary sump volume and guides the oil to the primary sump volume; and a second configuration in which the guide permits oil captured by the crankcase oil catchers above the secondary sump volume to flow into the secondary sump volume.

The configuration of the guide may be dependent on the temperature of the oil. For example, the configuration of the guide may be dependent on the temperature of the oil collecting on the guide.

The guide may be arranged in the second configuration such that at least some of the oil captured by the crankcase oil catchers above the secondary sump volume may flow onto the guide before flowing into the secondary sump volume. Alternatively, the guide may be arranged in the second configuration such that the oil captured by the crankcase oil catchers above the secondary sump volume may bypass the guide before flowing into the secondary sump volume.

The guide, e.g. all or a portion of the guide, may move between the first and second configurations.

The guide or a portion of the guide may rotate between the first and second configurations. The guide or the portion of the guide may rotate about an axis parallel or perpendicular to a longitudinal axis of the crankshaft.

The guide may comprise a movable portion that moves between the first and second configurations. The movable portion may be provided in a flow path along the guide to the primary sump portion. The movable portion may be arranged such that when in the second configuration oil flow may be diverted into the secondary sump portion.

The guide may move between the first and second configurations passively. The crankcase assembly may comprise a temperature sensitive portion that changes shape or state according to the surrounding temperature. Changes in the temperature sensitive portion may determine the configuration of the guide. The temperature sensitive portion may be operatively coupled to the guide (or movable portion) to move between the first and second configurations. By way of example, the crankcase assembly may comprise a thermostatic element comprising a wax, a liquid, a bimetallic strip or any other temperature sensitive portion.

Movement of the guide between the first and second configurations may be actively controlled. For example, the crankcase assembly may further comprise a controller, a temperature sensor operatively coupled to the controller; and an actuator, such as a solenoid, configured to move the guide between the first and second configurations.

The guides may extend in a direction parallel to a longitudinal axis of the crankshaft.

The crankcase assembly may comprise a plurality of crankcase oil catchers, e.g. one for each cylinder and piston of the engine. The guides may extend across one or more of the plurality of crankcase oil catchers, for example the guides may extend across a subset of the crankcase oil catchers and not all of the crankcase oil catchers. Alternatively, the guides may extend across the plurality of crankcase oil catchers, e.g. all of the crankcase oil catchers.

One or more first crankcase oil catchers may guide oil directly into the primary sump volume, e.g. without requiring the one or more guides. By contrast, one or more second crankcase oil catchers may be provided above the secondary sump volume and the guides may extend across the second crankcase oil catchers so as to direct oil into the primary volume.

The crankcase assembly may comprise a pair of guides with one guide on either side of the crankshaft.

The crankcase assembly may comprise a wall dividing the primary and secondary sump volumes. The guides may be integral with or separate from a wall dividing the primary and secondary sump volumes. The wall may comprise one or more openings configured to allow oil to pass between the primary and secondary sump volumes. The openings may be sized such that the flow rate of oil through openings depends on the temperature of the oil. The openings may be permanently open. The openings may be formed from a mesh or perforations.

The guides may comprise one or more openings configured to allow hot oil to pass through to the secondary sump volume beneath. The openings may be sized such that oil does not pass through openings when the oil is below a threshold temperature. The openings may be formed from a mesh or perforations.

Oil may be preferentially returned to the primary sump volume during warm-up of the engine. Restricting the initial volume of the sump may increase the rate at which the engine warms up.

The crankcase assembly may further comprise a valve provided between the primary and secondary sump volumes. The valve may be configured to selectively permit the flow of oil between the primary and secondary sump volumes, e.g. in response to a signal from a controller.

An oil pump may be provided in or above the secondary sump volume such that leakage from the oil pump may collect in the secondary sump volume. An oil pump pickup may be provided in the primary sump volume to collect oil from the primary sump volume for an oil pump.

The crankcase oil catcher may be configured to be provided above a crankshaft. The crankcase oil catcher may be configured to be provided below an associated piston. The crankcase oil catcher may be provided beneath an engine cylinder. The crankcase oil catcher may comprise a first aperture for a connecting rod to pass through. The width of the first aperture in a direction perpendicular and/or parallel to a longitudinal axis of the crankshaft may be smaller than the corresponding width of the associated engine cylinder.

The crankcase oil catcher may comprise a first lip provided around an edge defining the first aperture. The first lip may protrude form a top surface of the crankcase oil catcher. The first lip may protrude in a direction towards the piston.

The crankcase oil catcher may comprise a second aperture for a piston cooling jet to pass through or for receiving a duct for delivering a piston cooling jet. As for the first aperture, a lip may be provided around an edge defining the second aperture.

The crankcase oil catcher may be configured to be spaced apart from the crankcase casing wall. The crankcase oil catcher may be configured to substantially follow the contour of the crankcase casing wall. The crankcase oil catcher may be configured to substantially follow the contour of the crankcase casing wall in a plane perpendicular to a longitudinal axis of the crankshaft extending through the crankcase. A gap between the crankcase casing wall and the crankcase oil catcher may be between approximately 4 and 10 mm.

The crankcase oil catcher may be configured to be provided for a single cylinder of an engine. In other words, one crankcase oil catcher may be provided per piston. The crankcase oil catcher may be configured to be provided between walls between neighboring cylinders of an engine. However, it is also envisaged that the crankcase oil catcher may extend beneath a plurality of pistons.

The crankcase oil catcher may comprise a bottom surface. The bottom surface may face the crankshaft. The bottom surface may be configured to catch oil dispersed by a crankshaft, by a connecting rod and/or by a bearing between the crankshaft and the connecting rod. The crankcase oil catcher may comprise a top surface. The top surface may face the piston. The top surface may be configured to catch oil returning from above the crankcase, e.g. from a piston cooling gallery, a cylinder head or any other source of oil.

The crankcase oil catcher may comprise one or more second lips. The second lips may be provided on one or more edges of the crankcase oil catcher surfaces, e.g. on top and/or bottom surfaces of the crankcase oil catcher. The second lips may protrude above the top surface and/or below the bottom surface. The one or more second lips may be provided on edges of the crankcase oil catcher surfaces adjacent to the walls between neighboring cylinders of the engine. The one or more second lips may be provided on edges of the crankcase oil catcher surfaces substantially perpendicular to a longitudinal axis of a crankshaft extending through the crankcase.

The crankcase oil catchers and/or guides may be made from a thermally insulating material with a thermal conductivity lower than that of the crankcase. For example, the crankcase oil catchers and/or guides may be made at least in part from a plastics material, such as nylon. The crankcase oil catchers and/or guides may be connected to the crankcase casing wall via one or more thermally insulating couplings. Such couplings may be made from a plastic material, e.g. nylon.

An engine, such as an internal combustion engine, may comprise the above-mentioned crankcase assembly and/or crankcase oil catcher. Similarly, a vehicle, such as an automobile, van or any other motor vehicle, may comprise the above-mentioned engine, crankcase assembly and/or crankcase oil catcher.

BRIEF DESCRIPTION OF THE DRAWINGS

For a better understanding of the present disclosure, and to show more clearly how it may be carried into effect, reference will now be made, by way of example, to the accompanying drawings. The figures are drawn to scale, although other relative dimensions may be used, if desired.

DETAILED DESCRIPTION

Figure 1:
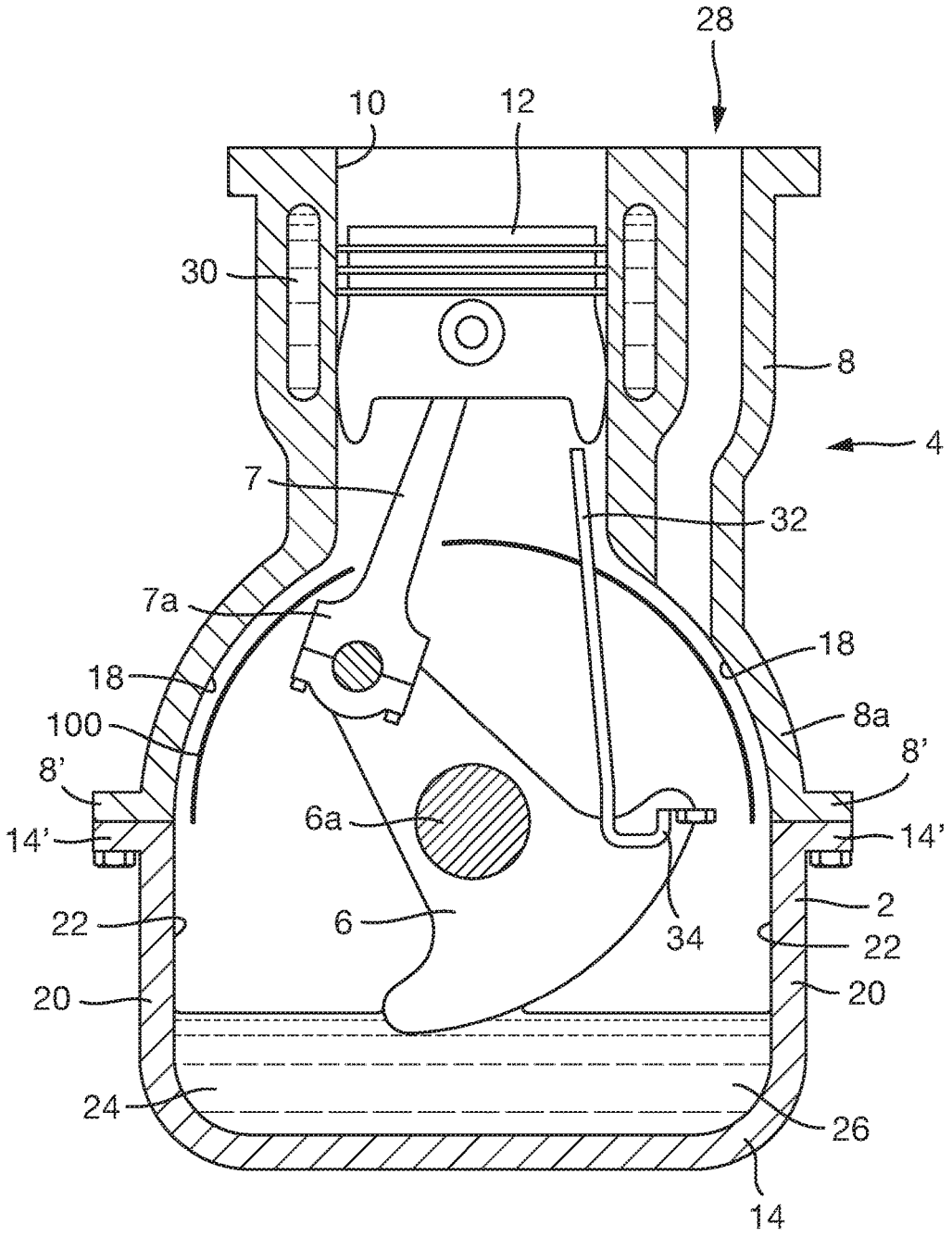
FIG. 1 shows a side sectional view of an engine in which there is provided a crankcase oil catcher according to a previously-proposed arrangement.
Figure 2:
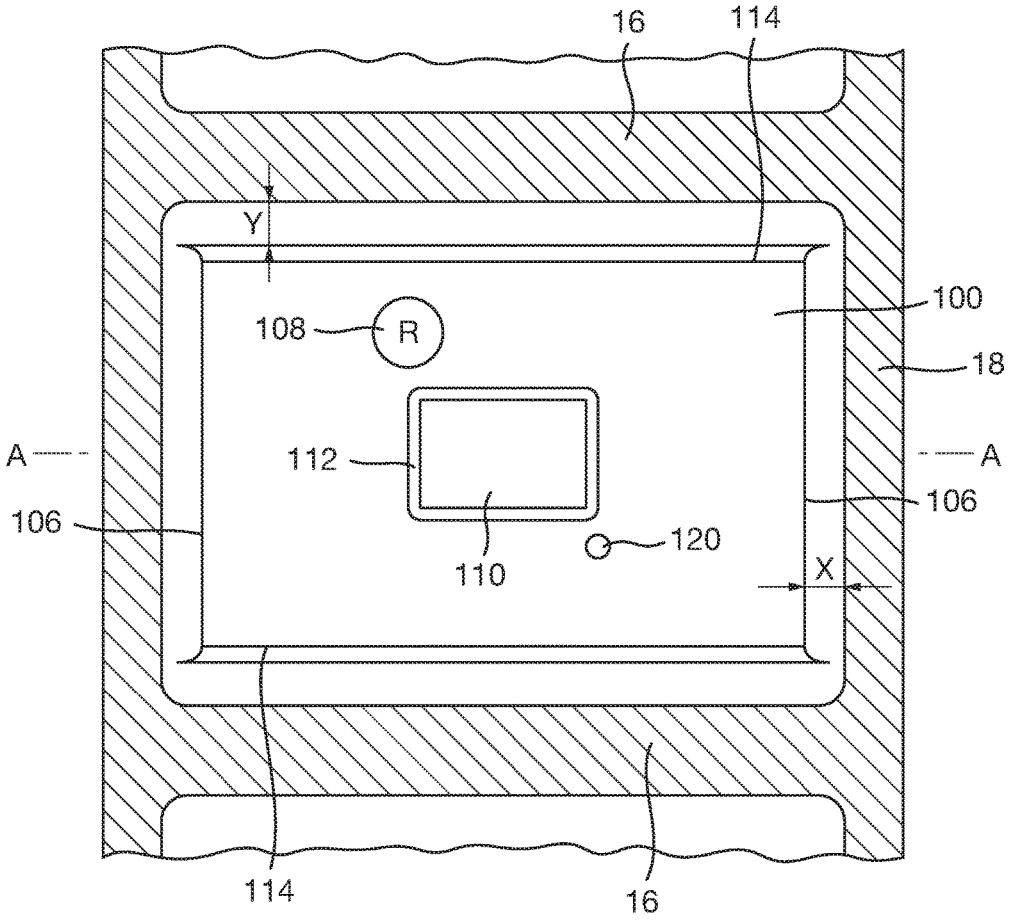
FIG. 2 shows a plan view of the crankcase oil catcher depicted in FIG. 1 (the crankshaft and connecting rod have been omitted for the sake of clarity).
Figure 3:
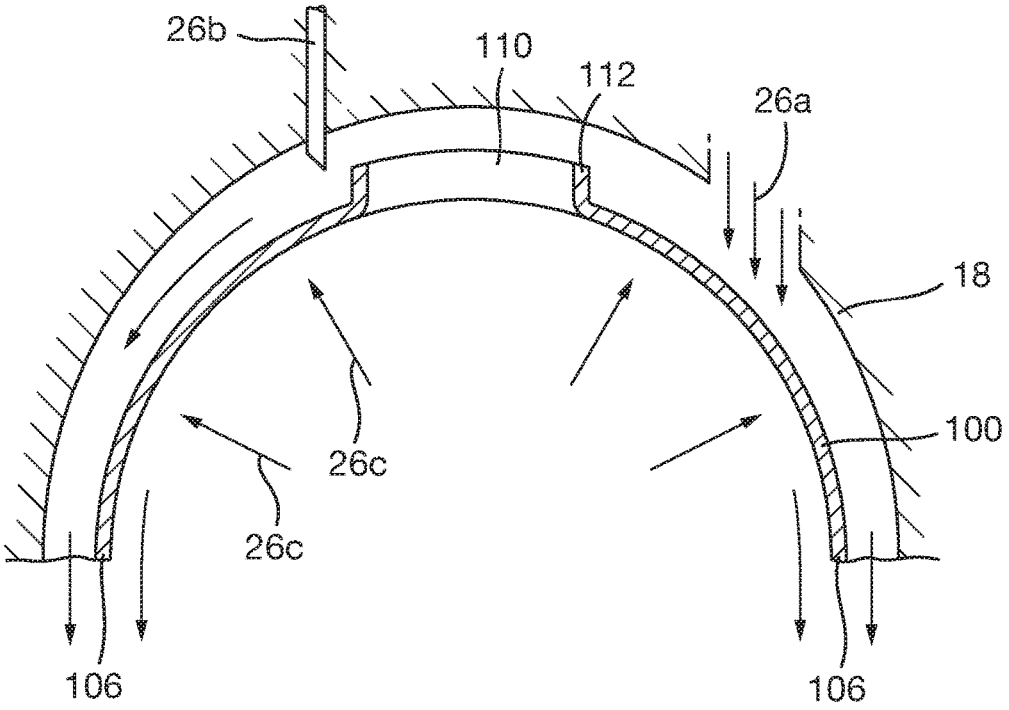
FIG. 3 shows a further side sectional view of the crankcase oil catcher depicted in FIG. 1 and is taken along section A-A shown in FIG. 2 (the crankshaft and connecting rod have been omitted for the sake of clarity).

With reference to FIGS. 1 to 3, the present disclosure relates to a crankcase assembly comprising one or more crankcase oil catchers 100. The crankcase oil catcher 100 is configured for placement in a crankcase 2 of an internal combustion engine 4. The crankcase 2 forms a housing for a crankshaft 6 of the engine. As depicted, the crankcase 2 may comprise a portion 8*a* of a cylinder block 8, the portion 8*a* extending below cylinders 10 for pistons 12. The crankcase 2 is completed by a sump portion 14, which may be coupled to the cylinder block portion 8*a* via flanges 8', 14'. Although not shown, it will be appreciated that other arrangements may apply, for example, the crankcase and cylinder block may be integral or the crankcase and cylinder block may be separate discrete components.

As is depicted in FIG. 1, the crankcase oil catcher 100 is provided above the crankshaft 6 and below the pistons 12. Accordingly, the crankcase oil catcher is provided beneath the engine cylinders 10. Furthermore, as is shown in FIG. 2, the crankcase oil catcher 100 may be provided between walls 16. The walls 16 divide neighboring cylinders 10 and may extend below the cylinders 10 into the crankcase 2. The walls 16 may provide supports for crankshaft bearing housings (not shown) and may be part of the cylinder block casting 8. Accordingly, one crankcase oil catcher 100 may be provided per cylinder 10 and associated piston 12. However, in alternative arrangements, the crankcase oil catcher may extend over any number of cylinders 10.

The crankcase oil catcher 100 may be spaced apart from an inner surface 18 of the crankcase 2. The inner surface 18 may be towards the top of the crankcase 2 and, in the particular example shown, the inner surface 18 may be provided on the portion 8*a* of cylinder block 8 that extends below cylinders 10. The crankcase oil catcher 100 may be substantially planar, e.g. plate-like, for example, with a thickness that is less than 1% of its length or width. The crankcase oil catcher 100 may lie in a plane that at least partially follows the contours of the inner surface 18 of the crankcase 2. As a result, the crankcase oil catcher 100 may be substantially parallel to the inner surface 18. The inner surface 18 and thus crankcase oil catcher 100 may trace out one or more arcs of a circle in a plane perpendicular to the crankshaft longitudinal axis 6*a*. The centre of the circle may substantially correspond to the longitudinal axis 6*a* of the crankshaft, e.g. the axis about which the crankshaft rotates. By contrast, the inner surface 18 and thus crankcase oil catcher 100 may be substantially straight in a direction parallel to the crankshaft longitudinal axis 6*a*. As a result the crankcase oil catcher 100 may at least partially correspond to a sector of a substantially cylindrical tube.

The crankcase oil catcher 100 may fit in a space between the crankcase inner wall 18 and an arc traced out by crankshaft 6 and a big end 7*a* of connecting rod 7 as the crankshaft 6 rotates. As depicted in FIG. 2, a gap X, e.g. in a radial direction, may exist between the crankcase casing wall 18 and the crankcase oil catcher 100. Gap X may vary or may be substantially constant, e.g. along the surface of the crankcase oil catcher. Gap X may be between approximately 4 and 10 mm. Similarly, a gap Y may exist between the dividing walls 16 and the crankcase oil catcher 100. Gap Y may be substantially constant. Gap Y may be small, e.g. between approximately 1 and 10 mm.

As shown in FIG. 1, sump walls 20 with inner facing sump surfaces 22 may be provided below the curved inner surface 18 of the crankcase 2. The sump walls 20 may be provided either side of the crankshaft 6. The sump surfaces 22 may be substantially straight and parallel. The sump surfaces 22 may be coincident with a tangent of the inner surface 18 at the interface between the sump surfaces 22 and inner surface 18. The sump walls 20 may form part of the sump portion 14, which may or may not be integral with casing potion 8*a*. The sump walls 20 may define a sump 24 which contains the oil 26 in the crankcase 2.

Referring to FIG. 1, the crankcase oil catcher 100 may extend downwards to a point substantially level with the crankshaft longitudinal axis 6*a*. Accordingly, in the case of the crankcase oil catcher 100 substantially tracing out an arc of a circle centred about the crankshaft longitudinal axis 6*a*, the crankcase oil catcher 100 may subtend an angle of approximately 180°. However, in alternative arrangements the crankcase oil catcher may extend to a point above the crank longitudinal axis, e.g. the crankcase oil catcher 100 may subtend an angle of less than 180°. This may be advantageous since oil running off the oil catcher 100 may be spaced further from sump surfaces 22 as the oil falls into the sump 24. Alternatively, the crankcase oil catcher may extend to a point below the crank longitudinal axis. For example, the crankcase oil catcher may follow the sump surfaces 22, which may as depicted be substantially straight. The crankcase oil catcher may even extend into the oil sump 24, e.g. below the oil level during use.

The crankcase oil catcher 100 comprises surfaces, which are configured to catch oil dispersed in the crankcase 2 and direct the oil along the surfaces of the crankcase oil catcher away from the crankcase walls 18, 22 and towards the crank sump 24. In particular, the crankcase oil catcher 100 comprises a top surface 102, which when installed faces the piston 12. Furthermore, the crankcase oil charger 100 comprises a bottom surface 104, which when installed faces the crankshaft 6.

Referring to FIGS. 2 and 3, the crankcase oil catcher 100 may comprise a first aperture 110 for the connecting rod 7 to pass through. The width of the first aperture 110 in a direction perpendicular to the longitudinal axis 6*a* of the crankshaft may be smaller than the corresponding width of the associated engine cylinder 10. Additionally or alternatively, the width of the first aperture 110 in a direction parallel to the longitudinal axis 6*a* of the crankshaft may be smaller than the corresponding width of the associated engine cylinder 10. As a result, oil falling down the side of cylinder 10 will be caught by the crankcase oil catcher 100.

As shown in FIG. 3, the crankcase oil catcher 100 may comprise a first lip 112 provided around an edge defining the first aperture 110. The first lip 112 may protrude from the top surface 102 of the crankcase oil catcher and may protrude in a direction towards the piston 12. The first lip 112 may prevent oil on the top surface 102 from falling through the first aperture 110.

As shown in FIG. 2, the crankcase oil catcher 100 may comprise a pair of second lips 114. The second lips 114 may be provided on edges of the crankcase oil catcher that are adjacent to the walls 16 between neighboring cylinders 10. Accordingly, the second lips 114 may be provided on the two edges of the crankcase oil catcher that are substantially perpendicular to the crankshaft longitudinal axis 6*a*. The second lips 114 may protrude above the top surface 102. As a result, the second lips 114 may prevent oil on the top surface 102 from falling over the edge adjacent to walls 16.

As depicted in FIGS. 1 and 2, the crankcase oil catcher 100 may comprise a second aperture 120 for a piston cooling jet 32 to pass through. The piston cooling jet 32 may be delivered from an oil duct 34 which directs the jet of oil 32 through the second aperture 120 and towards the piston 12. Alternatively, the duct for delivering the cooling jet 32 may extend through the second aperture 120. As for the first aperture 110, an upwardly projecting lip (not shown) may be provided around an edge defining the second aperture 120.

Referring to FIGS. 1 and 3, the top surface 102 may be configured to catch oil returning from above the crankcase, such as oil 26*a* returning from a cylinder head through passage 28 and/or oil 26*b* returning from the cylinder 10, e.g. from a piston cooling gallery 30 disposed about the cylinder 10. Accordingly, the crankcase oil catcher 100 may extend over the cylinder head oil drain passage 28 and/or a piston cooling gallery drain passage (not shown). For example, oil returning from the piston cooling gallery 30 may flow onto the top surface 102 at a point 108 on the top surface. Oil collected on the top surface 102 may then flow along the top surface by virtue of gravity. The oil may flow until it reaches a bottom edge 106 of the crankcase oil catcher 100 at which point the oil falls into the sump 24.

The bottom surface 104 may be configured to catch oil 26*c* dispersed by the crankshaft 6 and/or by the connecting rod big end 7*a*, e.g. as they pass through the oil 26 in the sump 24. Oil collected on the bottom surface 104 may then flow along the bottom surface by virtue of gravity and the oil's surface tension. The oil may flow until it reaches the bottom edge 106 of the crankcase oil catcher 100 at which point the oil falls into the sump 24.

In either case, the top and bottom surfaces 102, 104 may prevent oil returning to the sump 24 from contacting the crankcase walls 18, 16, 20, thereby minimising the heat lost by the oil to the crankcase 2. Furthermore, oil returning from above the crankcase may be prevented from simply falling directly into the crankcase, hitting the crankshaft or connecting rod and being flung out to the casing walls.

In addition, the crankcase oil catcher 100 and the air gap between the crankcase oil catcher 100 and crankcase inner surface 18 will act as thermal insulation barrier. The motion of the crankshaft 6 and connecting rods 7 creates a rotating flow of gas with an oil mist in the crankcase. Such a flow results in additional heat loss due to forced convection from the hot gases to the colder crankcase wall. Therefore, by adding the oil catcher 100 and the air gap between it and the inner surface 18, the amount of conduction and forced heat convection from the gas motion, as well as heat loss from the hot oil, will be reduced.

The crankcase oil catcher 100 may be moulded or bent into shape during construction. Furthermore, the crankcase oil catcher 100 may be made from a low conducting thermally insulating material, for example, a plastic material, such as nylon. The selection of such a material would minimise the thermal energy transferred from the oil falling on the crankcase oil catcher 100. In addition, although not shown, the crankcase oil catcher may be connected to the crankcase casing wall 18 via one or more thermally insulating couplings and such couplings may be made from a plastic material, e.g. nylon. The couplings may comprise a fir tree type fitting, screws or any other suitable coupling. The couplings may be received in openings in the crankcase wall 18. The crankcase oil catcher may additionally or alternatively comprise flanges (not shown), which may for example fit between flanges 8', 14' of the cylinder block portion 8*a* and sump portion 14 to hold the crankcase oil catcher in place.

Figure 4:
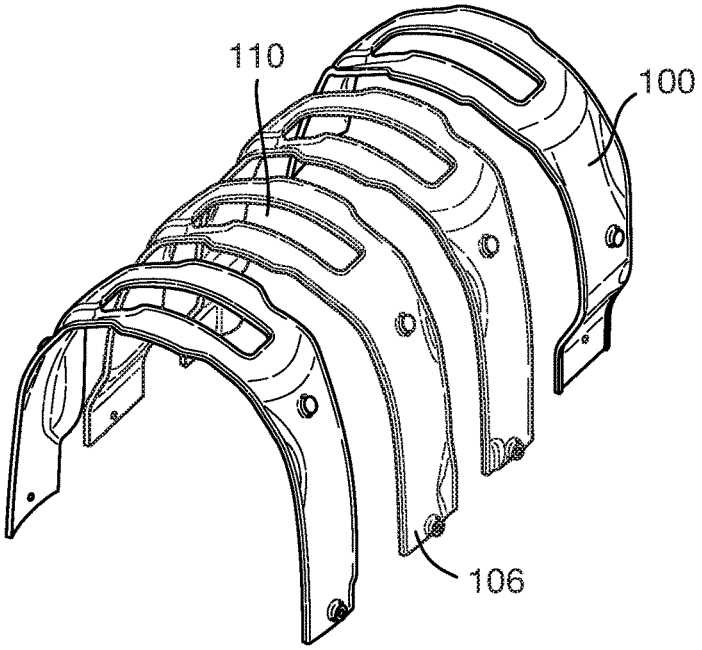
FIG. 4 shows a perspective view of four crankcase oil catchers aligned in an installed configuration (the engine has been omitted).
Figure 5:
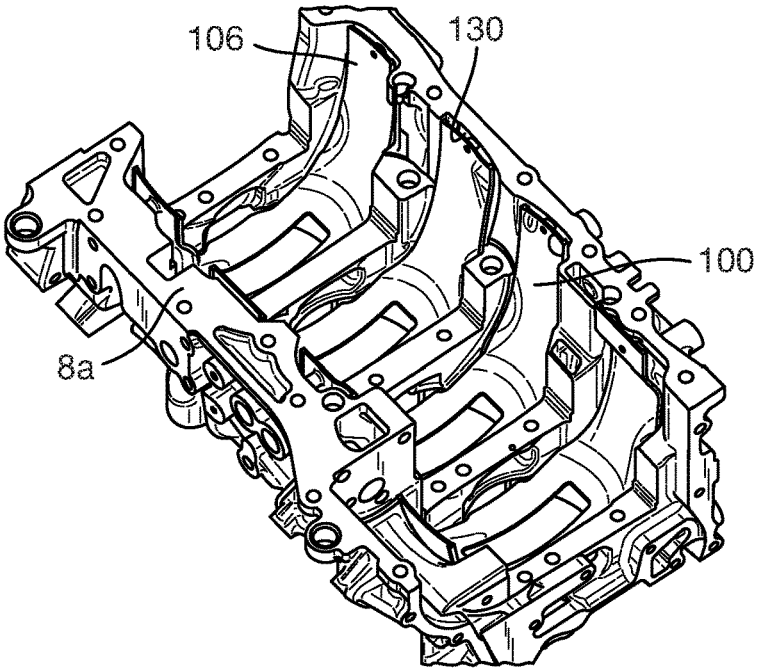
FIG. 5 shows a perspective view of the underside of the four crankcase oil catchers depicted in FIG. 4 installed into a crankcase of the engine.

With reference to FIGS. 4 and 5, a plurality of crankcase oil catchers 100 may be provided, for example with one crankcase oil catcher for each cylinder of the engine. In the particular example shown, four crankcase oil catchers 100 may be provided for an engine comprising four cylinders arranged in line.

FIG. 5 shows the crankcase oil catchers 100 depicted in FIG. 4 installed into the cylinder block portion 8*a* of the crankcase 2 of the engine. FIG. 5 shows an underside of crankcase oil catchers 100. As mentioned above, gaps 130 may be provided between crankcase inner surface 18 and the bottom edge 106 of the crankcase oil catchers 100. Oil captured by the crankcase oil catchers 100 may flow through the gaps 130 to the sump portion 14.

Figure 6:
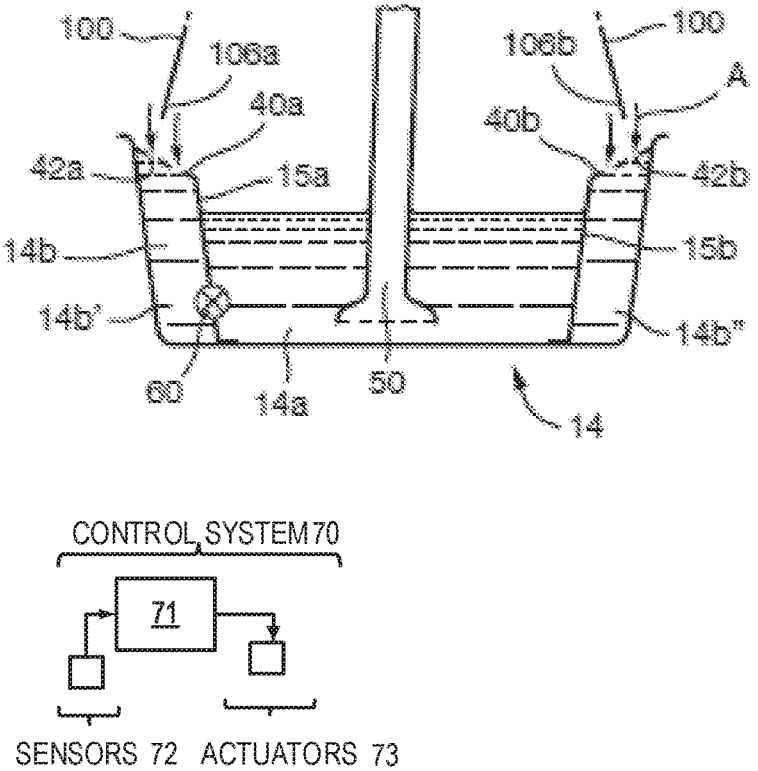
FIG. 6 shows a sectional view of a crankcase sump arrangement according to a previously-proposed example of the present disclosure.

Referring now to FIG. 6, an arrangement of the sump portion 14 will be described. As depicted, the sump portion 14 comprises a primary sump volume 14*a* and a secondary sump volume 14*b*. The secondary sump volume 14*b* may be divided into first and second secondary sump portions 14*b*' and 14*b*", which may be provided either side of the primary sump volume 14*a*. The first and second secondary sump portions 14*b*' and 14*b*" may be in fluidic communication with each other, e.g. in a plane behind that depicted in FIG. 6.

The primary and secondary sump volumes 14*a*, 14*b* are separated by first and second dividing walls 15*a*, 15*b*. The first dividing wall 15*a* separates the primary sump volume 14*a* from the first secondary sump portion 14*b*' and the second dividing wall 15*b* separates the primary sump volume from the second secondary sump portion 14*b*". The first and second dividing walls 15*a*, 15*b* may extend in a direction substantially parallel to the crankshaft longitudinal axis 6*a*. The dividing walls 15*a*, 15*b* may extend to a height that is substantially equal to the standard fill level for the oil.

As depicted, one or more crankcase oil catchers 100 are arranged with their bottom edges 106 arranged above the secondary sump volume 14*b*. In particular, a first bottom edge 106*a* on one side of the crankcase oil catcher 100 may be arranged above the first secondary sump portion 14*b*' and a second bottom edge 106*b* on the other side of the crankcase oil catcher 100 may be arranged above the second secondary sump portion 14*b*".

Referring still to FIG. 6, first and second guides 40*a*, 40*b* may be provided. The guides 40*a*, 40*b* may be provided beneath the bottom edges 106*a*, 106*b* of the crankcase oil catchers so that oil falling from the bottom edge of the crankcase oil catchers may drop onto the guides. (The oil flow is denoted by arrows A). In particular, the guides 40*a*, 40*b* may be positioned between the crankcase oil catcher bottom edges 106*a*, 106*b* and the corresponding first and second secondary sump portions 14*b*', 14*b*".

The first and second guides 40*a*, 40*b* may be configured to collect and guide oil captured by the crankcase oil catchers 100 into the primary sump volume 14*a*. For example, the first and second guides 40*a*, 40*b* may be angled relative to a horizontal plane and extend such that collected oil flows towards the primary sump volume 14*a*. In particular, the guides 40*a*, 40*b* may be angled with one side of the guide higher than the side of the guide that is closest to the primary sump volume 14*a*.

An edge of the guides 40*a*, 40*b* may be connected to a top edge of the respective dividing walls 15*a*, 15*b*. In particular, the guides 40*a*, 40*b* may be integral with the respective dividing walls 15*a*, 15*b*.

As mentioned above, the crankcase assembly may comprise a plurality of crankcase oil catchers 100, e.g. one for each cylinder 10 and piston 12 of the engine. The guides may extend across the bottom of each of these crankcase oil catchers. Accordingly, the guides 40*a*, 40*b* may be elongate and may extend in a direction parallel to the crankshaft longitudinal axis 6*a*.

As depicted, the guides 40*a*, 40*b* may comprise one or more openings 42*a*, 42*b* configured to allow hot oil to pass through to the first and second secondary sump portions 14*b*', 14*b*" beneath. The openings 42*a*, 42*b* may be sized such that oil does not pass through openings when the oil is below a threshold temperature, e.g. by virtue of the higher viscosity at lower temperatures. The openings 42*a*, 42*b* may be formed from a mesh or perforations.

An oil pump pick up 50 may be provided in the primary sump volume 14*a* to collect oil from the primary sump volume for an oil pump (not shown).

The crankcase assembly may further comprise a valve 60 provided in one or both of the first and second dividing walls 15*a*, 15*b*. The valve 60 may be configured to selectively permit the flow of oil between the primary and secondary sump volumes 14*a*, 14*b*. The valve 60 may be a thermostatic valve that automatically opens at a certain temperature. Alternatively, the valve 60 may be operatively connected to a controller, which sends a signal to open the valve when a sensor (not shown) indicates to the controller that the oil has reached a threshold temperature, for example 115° C.

The valve 60 may otherwise be opened in any of the following circumstances: if the oil level at the oil pump pick up 50 is low, even if the oil is cold, to avoid oil starvation. This could be determined by an oil level sensor, oil pressure sensor or both.

During power off or engine shut down. This allows the engine to be filled with oil and drained without any issues. It also allows a levelling of oil during drain down and oil to interchange between the two volumes.

It may also be advantageous to periodically open the valve 60 (for example, once in every 20 warm-up occurrences) if the engine does not warm up fully to allow the exchange of oil between the primary and secondary volumes.

Referring still to FIG. 6, the engine may be controlled at least partially by a control system 70 including controller 71. Controller 71 may receive various signals from sensors 72 coupled to the engine, and send control signals to various actuators 73 coupled to the engine and/or vehicle. The various sensors may include, for example, various temperature, pressure, and air-fuel ratio sensors, or the other sensors described herein. The various actuators may include the actuators described herein, for example, various valves, solenoids, throttles, and fuel injectors. The valve 60 may be operatively connected to the controller 71, which sends a signal to open the valve 60 via an actuator 73, for example. Controller 71 may be a microcomputer, including a microprocessor unit, input/output ports, an electronic storage medium for executable programs and calibration values. Controller 71 may be programmed with computer readable data representing instructions executable to perform the methods described herein as well as variants that are anticipated but not specifically listed.

Figure 7:
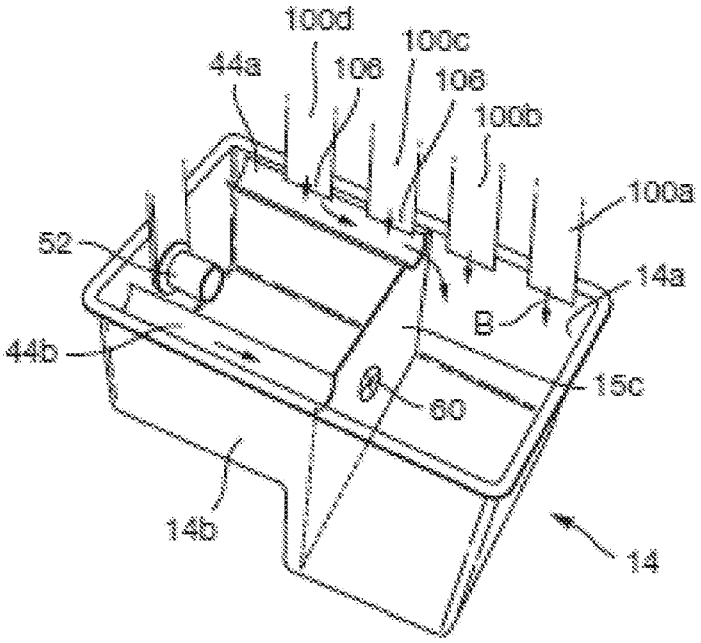
FIG. 7 shows a perspective view of a crankcase sump arrangement according to a further previously-proposed example of the present disclosure.

FIG. 7 shows an alternative arrangement for the sump portion 14. In contrast to the arrangement depicted in FIG. 6, the primary and secondary sump volumes 14*a*, 14*b* are separated by a single dividing wall 15*c*. The dividing wall 15*c* extends in a direction substantially perpendicular to the crankshaft longitudinal axis 6*a*. The primary sump volume 14*a* may also extend to a greater depth than the secondary sump volume 14*b*. Furthermore, the dividing wall 15*c* may extend to a height that is substantially equal to the standard fill level for the oil.

As depicted, a first set, e.g. pair, of crankcase oil catchers 100*a*, 100*b* may be provided above the primary sump volume 14*a* and may thus guide oil directly into the primary sump volume 14*a*. By contrast, a second set, e.g. pair, of crankcase oil catchers 100*c*, 100*d* may be provided above the secondary sump volume. A pair of guides 44*a*, 44*b* may extend beneath the bottom edges 106 of the second set of crankcase oil catchers 100*c*, 100*d* so as to collect oil falling from the bottom edges. (The oil flow is denoted by arrows B). The guides 44*a*, 44*b* are provided either side of the crankshaft and extend in a direction substantially parallel to the crankshaft longitudinal axis 6*a*. (NB, for the sake of clarity only one side of each crankcase oil catcher 100 is depicted in FIG. 7.)

The pair of guides 44*a*, 44*b* may be configured to direct oil into the primary sump volume 14*a*. In particular, the guides 44*a*, 44*b* may be angled relative to a horizontal plane (when installed) so that oil falls towards the primary sump volume 14*a*. The guides 44*a*, 44*b* may be angled with one end of the guide higher than the end of the guide that is closest to the primary sump volume 14*a*.

In contrast to the guides 40*a*, 40*b* depicted in FIG. 6, which may be substantially flat, the guides 44*a*, 44*b* may form a channel. For example, the guides 44*a*, 44*b* may be curved, e.g. within a cross section in the plane perpendicular to the crankshaft longitudinal axis 6*a*. Alternatively, the guides 44*a*, 44*b* may comprise sidewalls extending in the longitudinal direction, e.g. so as to form a gulley. In either case, the channel shape of the guides 44*a*, 44*b* may help to prevent oil falling from the guides into the secondary sump volume 14*b*.

An end of the guides 44*a*, 44*b* may be connected to a top edge of the dividing wall 15*c*. As for the arrangement shown in FIG. 6, the guides may be integral with the dividing wall 15*c*. Alternatively, the guides 44*a*, 44*b* may be separate components that may for example be connected to the sump walls 20. In a further alternative, the guides 44*a*, 44*b* may be connected to the bottom of the crankcase oil catchers 100.

As for the arrangement shown in FIG. 6, the guides 44*a*, 44*b* may have one or more openings (not shown) configured to allow hot oil to pass through to the secondary sump portion 14*b* beneath. The openings may be sized such that oil does not pass through openings when the oil is below a threshold temperature, e.g. by virtue of the higher viscosity at lower temperatures. The openings may be formed from a mesh or perforations.

Again, as for the arrangement shown in FIG. 6, the valve 60 may be provided in the dividing wall 15*c* to selectively permit flow between the primary and secondary sump volumes 14*a*, 14*b*. The valve 60 may function in the same way as described above.

An oil pump 52 may be provided in the secondary sump volume 14*b*. Accordingly, leakage from the oil pump may collect in the secondary sump volume. This may help promote exchange of oil between the two sump volumes. However, to avoid the pump running dry, an oil pump pick up (not shown) may be provided in the primary sump volume 14*a* to collect oil from the primary sump volume for an oil pump.

Figure 8:
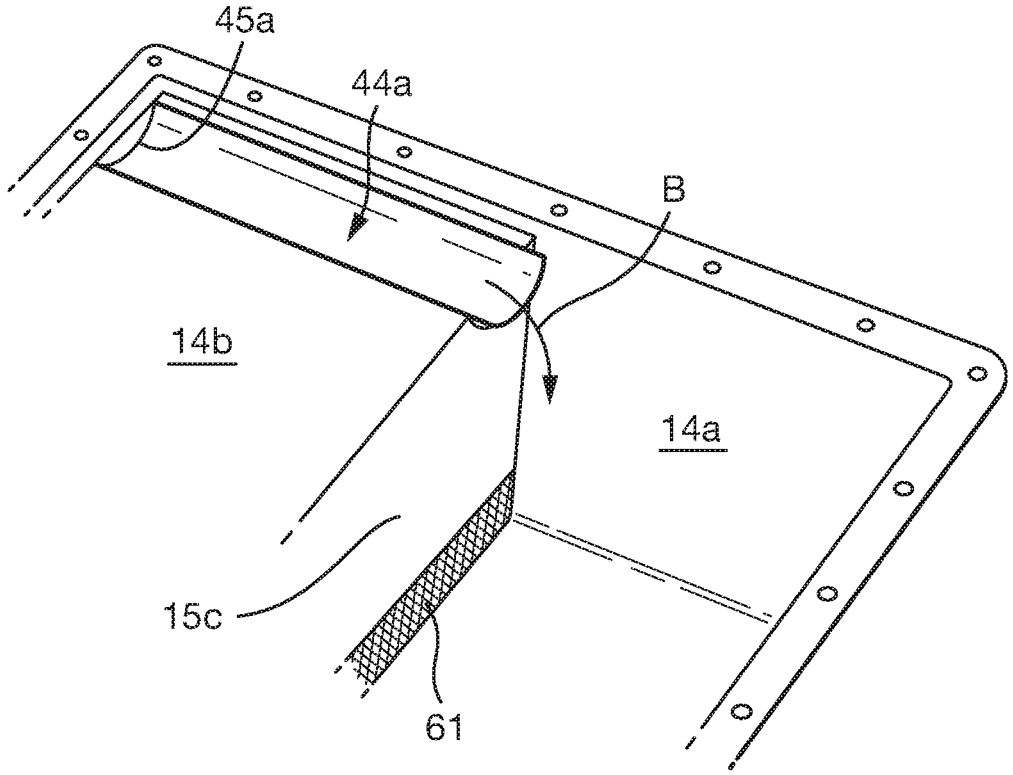
FIG. 8 shows a perspective view of a crankcase sump arrangement according to an example of the present disclosure.
Figure 9A:
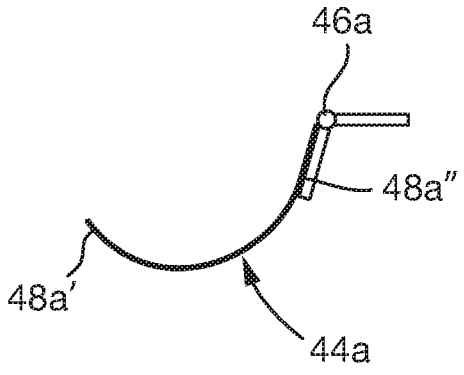
FIG. 9A shows a sectional side view of the guide in the first configuration.
Figure 9B:
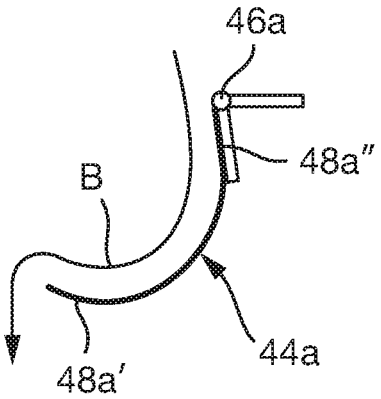
FIG. 9B shows a sectional side view of the guide in the second configuration.

Referring now to FIGS. 8 to 10B, the guides 44*a*, 44*b* may be movable between a first configuration (as depicted in FIG. 9A) and a second configuration (as depicted in FIG. 9B). In the first configuration the guides 44*a*, 44*b* collect oil captured by the crankcase oil catchers 100*c*, 100*d* above the guides 44*a*, 44*b* and guide the oil to the primary sump volume 14*a*, which would otherwise have flowed into the secondary sump volume 14*b*. In the second configuration the guides 44*a*, 44*b* have moved into a position in which the oil collected from the crankcase oil catchers 100*c*, 100*d* above is directed to flow into the secondary sump volume 14*b*. Although the partial views of FIGS. 8 to 10B show only a single guide 44*a*, 44*b*, it will be appreciated that a pair of guides may be provided in a manner similar to that shown in FIG. 7. Other features described in relation to the guides shown in FIG. 7 may also apply to the guides shown in FIGS. 8 to 10B.

As is shown in FIGS. 9A and 9B, the guides 44*a*, 44*b* may rotate about a pivot point 46*a* between the first and second configurations. The pivot axis extends in a direction parallel to the longitudinal axis of the crankshaft. However, it will be appreciated that the guides 44*a*, 44*b* may rotate about an axis orientated in a different direction, for example an axis perpendicular to the longitudinal axis of the crankshaft. It will also be appreciated that the guides 44*a*, 44*b* may move in a different way, e.g. translating or bending between the first and second configurations.

As is shown in FIG. 9B, the guides 44*a*, 44*b* may be arranged in the second configuration such that at least some of the oil captured by the crankcase oil catchers 100*c*, 100*d* above the secondary sump volume 14*b* may first flow onto the guide before then flowing into the secondary sump volume 14*b*. Alternatively, the guide may be arranged in the second configuration such that the oil falling on the crankcase oil catchers does not flow onto the guides 44*a*, 44*b* and instead flows directly into the secondary sump volume. For example, the guides 44*a*, 44*b* may move to such an extent that they move out of the flow path from the crankcase oil catchers to the secondary sump volume.

Figure 10A:
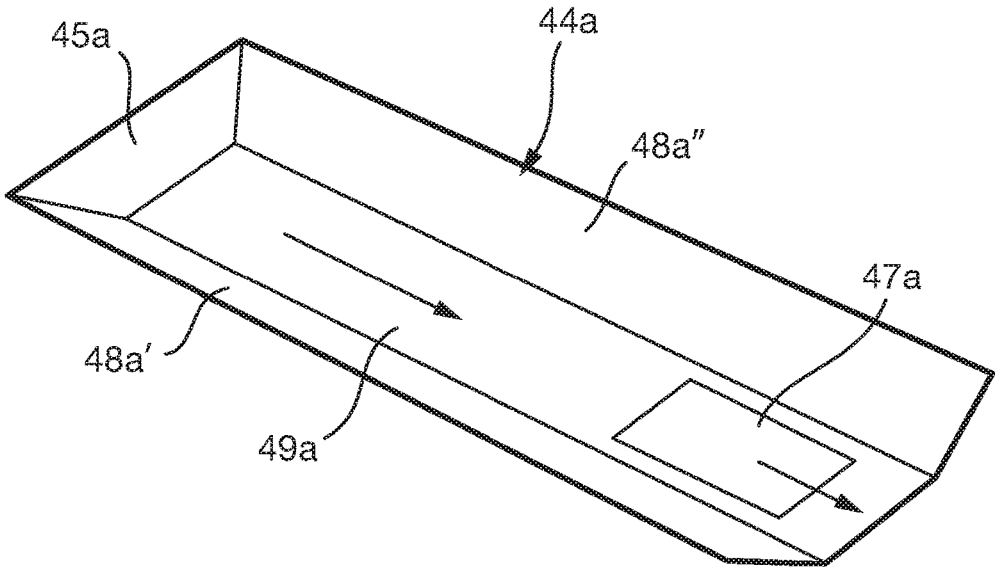
FIG. 10A shows a perspective view of an alternative guide according to an example of the present disclosure in the first configuration.
Figure 10B:
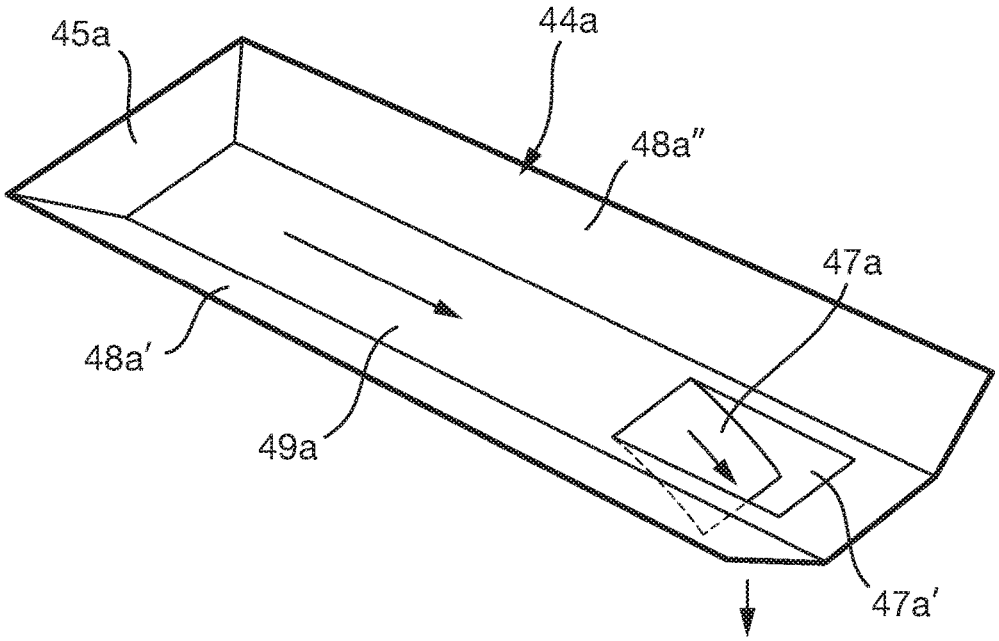
FIG. 10B shows a perspective view of an alternative guide according to an example of the present disclosure in the second configuration.

In the particular arrangement shown in FIGS. 8 and 9A-9B, the guides 44*a*, 44*b* have a concave cross sectional shape. The cross sectional shape of the guide may be curved, e.g. as depicted in FIGS. 9A and 9B, or angular, e.g. as depicted in FIGS. 10A and 10B. In either case, side walls 48*a*', 48*a*" of the guides 44*a*, 44*b* may contain the flow of oil within the guide when in the first configuration. By contrast, in the second configuration one side of the guide may be lowered such that the side walls are no longer able to contain the flow of oil along the length of the guide. As a result, oil may flow over the edge of one of the side walls 48*a*' and into the secondary sump portion 14*b* beneath.

The guide 44*a* may be provided with an end wall 45*a* provided at the end of the guide opposite the primary sump portion 14*a*. The end wall 45*a* may prevent unwanted flow of the oil over the end of the guide into the secondary sump portion.

As shown in FIG. 8, the guide 44*a* overlaps (i.e. overhangs) the dividing wall 15*c* so that oil captured by the guide flows into the primary sump portion 14*a*. The dividing wall 15*c* may thus be provided with a cut out through which the guide may pass. The cut out may be sized to accommodate the guide 44*a* in both the first and second configurations.

In an alternative arrangement (not shown) the guide 44*a* may be connected to the dividing wall 15*c*, for example the guide 44*a* may rotate about the connection with the dividing wall 15*c*, e.g. with a rotational axis perpendicular to the longitudinal axis of the crankshaft. With such an arrangement oil may flow along the guide 44*a* in a first direction towards the primary sump portion when in the first configuration and the oil may flow in a second opposite direction when in the second configuration. In such an arrangement the end wall 45*a* may be omitted.

The configuration of the guides 44*a*, 44*b* may be dependent on the temperature of the oil. For example, the temperature of the oil collecting on the guide, in the primary sump volume 14*a* or elsewhere may determine whether the guide is in the first or second configuration. In a particular arrangement, the guide may move between first and second configurations passively. By way of example, the crankcase assembly may comprise a temperature sensitive portion that changes shape or state according to the surrounding temperature. The changing shape or state of the temperature sensitive portion may determine the configuration of the guide 44*a*. The temperature sensitive portion may be operatively coupled to the guide 44*a* to move the guide between the first and second configurations. For example, the crankcase assembly may comprise a thermostatic element comprising a wax, a liquid, a bimetallic strip or any other temperature sensitive portion that is arranged to move the guide between the first and second configurations depending on the surrounding temperature. The temperature sensitive portion may be in thermal communication with the oil falling on the guides 44*a*, 44*b*.

Alternatively, movement of the guides 44*a*, 44*b* between the first and second configurations may be actively controlled. For example, the crankcase assembly may further comprise a controller (cf. FIG. 6), a temperature sensor operatively coupled to the controller, and an actuator configured to move the guide between the first and second configurations. The temperature sensor may sense the temperature of the oil falling onto the guide 44*a*, 44*b*, the temperature of the oil in the primary sump volume or elsewhere. When the temperature of the oil reaches a threshold value, the controller may send a signal to the actuator to move the guides 44*a*, 44*b* from the first configuration to the second configuration. When the temperature falls below the threshold value, the controller may send a further signal to the actuator to return the guides 44*a*, 44*b* to the first configuration. The actuator may be coupled to both of the guides 44*a*, 44*b* or an actuator may be provided for each of the guides. The actuator may be a linear actuator or any other type of actuator, such as a motor or solenoid.

If the configuration of the guides 44*a*, 44*b* is actively controlled, then the controller may additionally or alternatively move the guides between the first and second configurations based on factors other than temperature. For example, if the oil level in the sump volume with the oil pick up is running low, the guides may be adjusted to direct oil flow into that sump volume.

In the arrangement shown in FIG. 8, the dividing wall 15*c* comprises a mesh portion 61. The mesh portion 61 comprises one or more openings that allow oil to pass between the primary and secondary sump volumes 14*a*, 14*b*. The mesh portion 61 may be provided instead of the valve 60 mentioned above. The mesh portion openings may be sized such that the flow rate of oil through the openings is low when the temperature of the oil is below a certain threshold. The flow between the primary and secondary sump volumes 14*a*, 14*b* will therefore be limited when the temperature of the oil is low. By contrast, when the temperature of the oil is high and the oil is less viscous as a result, the flow rate of oil through the mesh portion openings may increase. The mesh portion 61 may thus permit a greater transfer of oil between the primary and secondary sump volumes when the temperature of the oil is hot. The mesh portion 61 has no moving parts and may thus be more reliable than a valve between the primary and second sump volumes.

The arrangement shown in FIG. 8 is similar to that shown in FIG. 7 except that the guides 44*a*, 44*b* are movable between the first and second configurations. However, the guides 40*a*, 40*b* shown in FIG. 6 may also be movable between first and second configurations. For example, the guides 40*a*, 40*b* shown in FIG. 6 may move from a first configuration similar to that depicted in FIG. 6 to a second configuration in which the guides 40*a*, 40*b* permit the flow of oil from the oil crankcase catchers 100 to flow into the first and second secondary sump portions 14*b*' and 14*b*". Other features described above in respect of the guides 44*a*, 44*b* may also apply to the guides 40*a*, 40*b*.

Referring now to FIGS. 10A and 10B, a portion 47*a* of the guide 44*a* may be movable between a first configuration (as depicted in FIG. 10A) and a second configuration (as depicted in FIG. 10B) and the remainder of the guide may remain in the same position regardless of the configuration. The movable portion 47*a* may be provided in the flow path along the guide 44*a* to the primary sump portion 14*a*. For example, the movable portion 47*a* may be provided on a bottom 49*a* of the guide 44*a*. In particular, the movable portion 47*a* may be provided at or towards an end of the guide that is closest to the first sump portion 14*a*. The movable portion 47*a* may substantially close (e.g. fill) an opening 47*a*' in the bottom 49*a* of the guide 44*a* when in the first configuration. Oil flowing along the guide 44*a* may thus flow over the movable portion 47*a* and then into the first sump portion 14*a*. However, when in the second configuration the movable portion 47*a* may move away from the opening 47*a*' in the guide such that oil travelling along the guide 44*a* flows through the opening and into the secondary sump portion 14*b*. In effect the movable portion 47*a* forms a trapdoor which opens when the oil has reached a threshold temperature and diverts the oil into the secondary sump portion 14*b*.

The movable portion 47*a* may comprise a bimetallic strip that changes shape according to the temperature of the oil flowing over the movable portion. For example, as the temperature of the oil increases, the movable portion may flex from the first configuration to the second configuration. Although FIG. 10B shows a movable portion bending along an edge furthest from the first sump portion, it will be appreciated that the movable portion 47*a* may equally bend along an edge closest to the first sump portion. Equally, the movable portion 47*a* may be actively controlled instead of being passive, for example in the manner described above in relation to FIGS. 8, 9A and 9B.

In any of the arrangements depicted in FIGS. 6 to 10B, the guides and/or dividing walls may be made from a thermally insulating material, for example a plastic such as nylon.

With the arrangements depicted in FIGS. 6 to 10B, oil may be preferentially returned to the primary sump volume 14*a* during warm-up of the engine. Restricting the initial volume of the sump to the primary sump volume 14*a* may increase the rate at which the engine warms up by reducing the exposure of the oil to the thermal mass of the sump walls. The combination of the above-described guides and crankcase oil catchers helps to increase the amount of oil returned to the primary volume. In the case of the arrangements shown in FIGS. 6 and 7, the valve 60 may open once the engine has warmed up and the primary and secondary sump volumes may effectively be combined. The openings 42*a*, 42*b* may also begin to permit flow into the secondary sump volume 14*b*. In the case of the arrangement shown in FIG. 8, the guides may move to permit flow into the secondary sump volume 14*b* from the oil catchers above once the engine has warmed up. The mesh 61 may also permit a larger flow between the primary and second sump volumes. Greater cooling of the oil may then be achieved through the increased exposure to the sump walls 20.

FIGS. 1-10B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

It will be appreciated by those skilled in the art that although the disclosure has been described by way of example with reference to one or more examples, it is not limited to the disclosed examples and that alternative examples could be constructed without departing from the scope of the disclosure as defined by the appended claims.

The invention claimed is:

1. A crankcase assembly for an engine comprising:

a crankcase comprising a crank sump; the crank sump comprising a primary sump volume and a secondary sump volume;

one or more crankcase oil catchers, the crankcase oil catchers comprising one or more surfaces configured to catch dispersed oil in the crankcase and direct the oil along the surfaces of the crankcase oil catcher away from a crankcase casing wall and towards the crank sump, wherein the crankcase oil catchers are provided above a crankshaft and below an associated piston of the engine; and a guide configured to collect oil captured by one or more of the crankcase oil catchers and guide the oil to the primary sump volume, wherein the guide is provided beneath a bottom edge of the one or more crankcase oil catchers such that oil falling from the bottom edge of the crankcase oil catchers drops onto the guide at least when in the first configuration, and wherein at least a portion of the guide is movable between:

a first configuration in which the guide collects oil captured by the one or more crankcase oil catchers that would otherwise have flowed into the secondary sump volume and guides the oil to the primary sump volume; and a second configuration in which the guide permits oil captured by the one or more crankcase oil catchers above the secondary sump volume to flow into the secondary sump volume.

2. The crankcase assembly as claimed in claim 1, wherein the configuration of the guide is dependent on a temperature of the oil.

3. The crankcase assembly as claimed in claim 2, wherein the configuration of the guide is dependent on the temperature of the oil collecting on the guide.

4. The crankcase assembly as claimed in claim 1, wherein the guide is arranged in the second configuration such that at least some of the oil captured by the crankcase oil catchers above the secondary sump volume flows onto the guide before flowing into the secondary sump volume.

5. The crankcase assembly as claimed in claim 1, wherein the guide is arranged in the second configuration such that the oil captured by the crankcase oil catchers above the secondary sump volume bypasses the guide before flowing into the secondary sump volume.

6. The crankcase assembly as claimed in claim 1, wherein the guide moves between the first and second configurations.

7. The crankcase assembly as claimed in claim 1, wherein the guide or a portion of the guide rotates between the first and second configurations.

8. The crankcase assembly as claimed in claim 7, wherein the guide or the portion of the guide rotates about an axis parallel to a longitudinal axis of the crankshaft.

9. The crankcase assembly as claimed in claim 7, wherein the guide or the portion of the guide rotates about an axis perpendicular to a longitudinal axis of the crankshaft.

10. The crankcase assembly as claimed in claim 1, wherein the guide comprises a movable portion that moves between the first and second configurations.

11. The crankcase assembly as claimed in claim 10, wherein the movable portion is provided in a flow path along the guide to the primary sump portion and the movable portion is arranged such that when in the second configuration oil flow is diverted into the secondary sump portion.

12. The crankcase assembly as claimed in claim 1, wherein the crankcase assembly comprises a temperature sensitive portion that changes shape or state according to the surrounding temperature.

13. The crankcase assembly as claimed in claim 1, wherein the crankcase assembly further comprises a controller, a temperature sensor operatively coupled to the controller; and an actuator configured to move the guide between the first and second configurations.

14. The crankcase assembly as claimed in claim 1, wherein the guide extends in a direction parallel to a longitudinal axis of the crankshaft.

15. The crankcase assembly as claimed in claim 1, wherein the crankcase assembly comprises a pair of guides with one guide on either side of the crankshaft; and wherein the crankcase oil catchers and/or guides are made at least in part from a plastics material.

16. The crankcase assembly as claimed in claim 2, wherein the crankcase assembly comprises a wall dividing the primary and secondary sump volumes.

17. The crankcase assembly as claimed in claim 16, wherein the wall comprises one or more openings configured to allow oil to pass between the primary and secondary sump volumes.

18. The crankcase assembly as claimed in claim 17, wherein the openings are sized such that the flow rate of oil through the openings depends on the temperature of the oil.

19. The crankcase assembly as claimed in claim 17, wherein the openings are formed from a mesh or perforations.

20. The crankcase assembly as claimed in claim 1, wherein oil is returned to the primary sump volume during warm-up of the engine; and wherein the crankcase oil catchers and/or guides are made from a thermally insulating material with a thermal conductivity lower than that of the crankcase.

* * * * *